US006597798B1

(12) United States Patent
Nakazono et al.

(10) Patent No.: US 6,597,798 B1
(45) Date of Patent: Jul. 22, 2003

(54) LOUDSPEAKER

(75) Inventors: Jiro Nakazono, Yamagata-ken (JP); Shigeru Watanabe, Yamagata-ken (JP)

(73) Assignees: Pioneer Electronics Corporation, Tokyo (JP); Tohoku Pioneer Electronic Corporation, Yamagata-ken (JP)

( * ) Notice: Subject to any disclaimer, the term of this patent is extended or adjusted under 35 U.S.C. 154(b) by 0 days.

(21) Appl. No.: 09/203,498

(22) Filed: Dec. 1, 1998

(30) Foreign Application Priority Data

Dec. 2, 1997 (JP) ..... 9-347154

(51) Int. Cl.[7] ..... H04R 25/00

(52) U.S. Cl. ..... 381/410; 381/403; 381/404; 381/398; 381/396; 381/412

(58) Field of Search ..... 381/396, 398, 381/400, 401, 403, 405, 412, 409, 410, 432, 404

(56) References Cited

U.S. PATENT DOCUMENTS 3,014,996 A * 12/1961 Swanson
5,091,958 A * 2/1992 Sakamoto
5,757,945 A * 5/1998 Sakamoto
6,269,167 B1 * 7/2001 Mango

* cited by examiner

*Primary Examiner*—Rexford Barnie
*Assistant Examiner*—Dionne Harvey
(74) *Attorney, Agent, or Firm*—Arent Fox Kintner Plotkin & Kahn

(57) ABSTRACT

A loudspeaker has a cylindrical frame, a magnetic circuit formed on the frame, a voice coil disposed in a magnetic gap of the magnetic circuit, a diaphragm. A damper is attached to the frame and supports the voice coil. Leads are connected to both ends of the voice coil. The leads are attached to the damper by stitching.

5 Claims, 4 Drawing Sheets

LOUDSPEAKER

BACKGROUND OF THE INVENTION

The present invention relates to a loudspeaker, and more particularly to a damper provided in the loudspeaker.

A loudspeaker provided in an audio system is an electroacoustic device that converts an electric signal (electrical energy) into an acoustic signal (sound energy). ELectrodynamic loudspeakers, which are superior in quality of the reproduced sound and other properties are widely used today.

The loudspeakers are mounted in audio systems of various shapes, so that it is preferable to reduce the thickness of the speaker as much as possible.

FIGS. 4*a* and 4*b* are a plan view and a sectional view showing a main part of a conventional electrodynamic loudspeaker, respectively. Referring to the figures, the conventional electrodynamic loudspeaker has a yoke 103, magnet 102 mounted on the yoke 103, and a pole piece 101 mounted on the magnet, thereby forming a magnetic circuit including an annular magnetic gap.

The magnetic gap is formed between the pole piece 101 and the yoke 103, the distance there-between being maintained substantially constant along the entire length. A frame 104 made of such a material as a resin is attached to the yoke 103 along the outer periphery thereof, thereby forming a frame assembly as well as the magnetic circuit.

A conical diaphragm 105 having a center hole is mounted above the pole piece 101. The outer periphery of the diaphragm 105 is secured to the frame 104 through an edge 106 attached to the frame.

A cylindrical voice coil bobbin 108*a* is provided in the hole of the diaphragm 105, the upper periphery attached thereto. A voice coil 108 is mounted in a space between the yoke 103 and the pole piece 101, surrounding the bobbin 108*a*.

The voice coil bobbin 108*a* is supported by the frame 104 through a damper 107. The damper 107 resiliently supports the diaphragm 105 held by the edge 106, voice coil 108 and the voice coil bobbin 108*a* at the respective predetermined positions, and further suspensively supports the voice coil 108 within the magnetic gap.

In order to reinforce the diaphragm 105, a cap 110 is mounted on the center portion of the diaphragm 105, so as to cover the center hole thereof.

The ends of the voice coil 108 are directed out of the coil bobbin 108*a* so as to be connected to leads 108*b*. Each lead 108*b* is securely mounted on the outer wall of the voice coil bobbin 108*a* and on the upper surface of the diaphragm 105 by an adhesive A. Each lead 108*b* further passes through the diaphragm 105 to the underside thereof, and is electrically connected to a terminal 109 provided on the frame 104.

In the thus constructed loudspeaker, when applied with driving current through the terminals 109, the suspended voice coil 108 generates a driving force. The driving force renders the voice coil bobbin 108*a* to vibrate the diaphragm 105, thereby generating sounds.

Since the diaphragm 105 is deflected in the driving direction in operation, in order to prevent the diaphragm 105 from tensing and being exerted with a load, it necessary for each of the leads 108 to have a sufficient length between the diaphragm and the terminal 109 to keep the lead lax.

However, when the length of the lead 108*b* is long, due to the natural frequency thereof, the lead 108*b* may be deflected in a direction opposite from the moving direction of the diaphragm 105 and the damper 107 during the operation. As a result, the leads 108*b* collide against the diaphragm and the damper, thereby giving a shock. Consequently, a noise may be generated in the reproduced sound, and the lead 108 may be cut off.

In order to prevent such an accident, a sufficient space is needed between the diaphragm 105 and the damper 107 so that the leads 108*b* do not contact either of them. As a result, the thickness of the loudspeaker in the driving direction of the diaphragm is increased so that there is a limit in rendering the loudspeaker thin.

SUMMARY OF THE INVENTION

An object of the present invention is to provide a loudspeaker having a reduced thickness wherein the lead is prevented from colliding against the diaphragm and the damper.

According to the present invention, there is provided a loudspeaker having a cylindrical frame, a magnetic circuit formed on the frame, a voice coil disposed in a magnetic gap of the magnetic circuit, a diaphragm, comprising, a damper attached to the frame and supporting the voice coil, and leads connected to both ends of the voice coil, the leads being attached to the damper from an inner portion to an outer portion by stitching.

The present invention further provides a loudspeaker having a cylindrical frame, a magnetic circuit formed on the frame, a voice coil disposed in a magnetic gap of the magnetic circuit, a diaphragm, comprising, an annular damper attached to the frame at an outer periphery and connected to the voice coil at an inner periphery so as to support the voice coil in a floating state, leads connected to both ends of the voice coil, the leads being attached to the damper from an inner portion to an outer portion by stitching.

The damper has a corrugated sectional shape, and each of the leads is spirally disposed on the damper.

These and other objects and features of the present invention will become more apparent from the following detailed description with reference to the accompanying drawings.

DETAILED DESCRIPTION OF THE PREFERRED EMBODIMENT

Figure 1A:
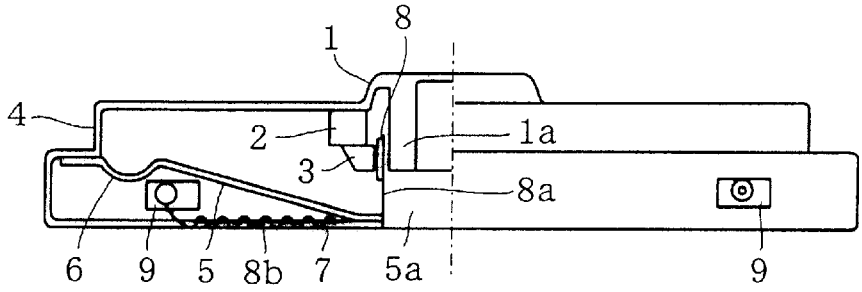
FIG. 1*a* is a partially sectional side view showing a main part of a loudspeaker according to the present invention.
Figure 1B:
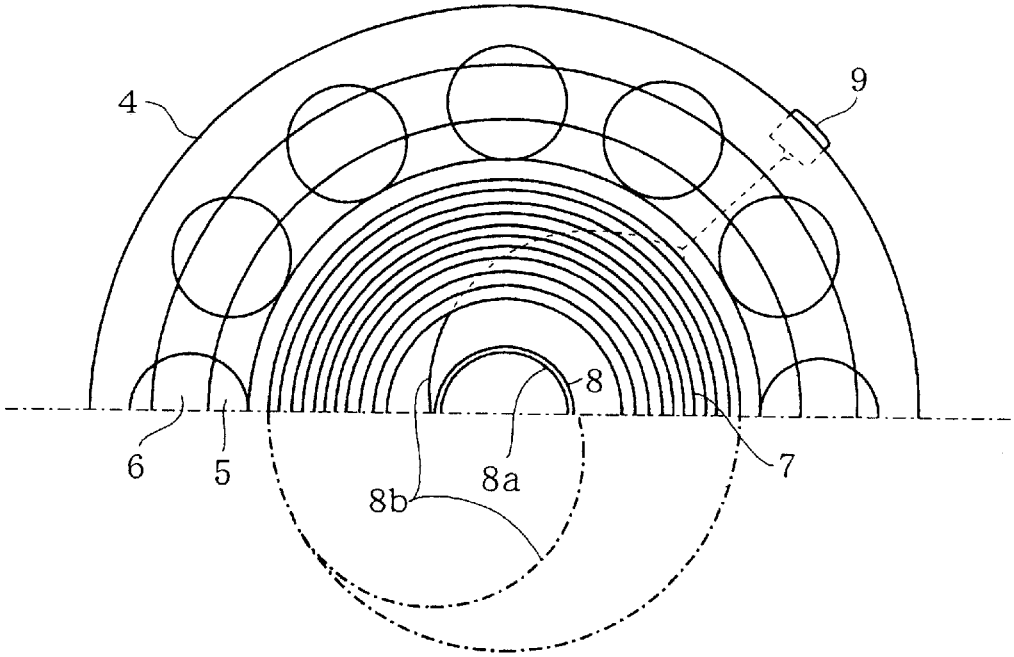
FIG. 1*b* is a plan view of a part of the loudspeaker.

Referring to FIGS. 1*a* and 1*b*, a loudspeaker of the present invention has a yoke 1 having a downwardly extending annular pole piece 1*a*, annular magnet 2 mounted on the yoke 1 surrounding the pole piece 1*a*, and an annular plate 3 mounted on the magnet 2, thereby forming a magnetic circuit including an annular magnetic gap. The magnetic gap is formed between the pole piece 1*a* and the plate 3, the distance there-between being maintained substantially constant along the entire length. A frame 4 made of resin, for example, is formed on the periphery of the yoke 1, thereby forming a frame assembly as well as the magnetic circuit.

A conical diaphragm 5 having a center hole 5*a* is provided under the plate 3. The outer periphery of the diaphragm 5 is so supported by an edge 6 securely mounted on the frame 4 that the diaphragm 5 can be moved in the driving direction, namely vertically in FIG. 1*a*. A cylindrical voice coil bobbin 8*a* is provided in the hole 5*a*. The voice coil bobbin 8*a* is further attached to an inner periphery of an annular damper 7 which is mounted in the frame 4 at the bottom thereof. A voice coil 8 is mounted in a space between the plate 3 and the pole piece 1*a*, surrounding the bobbin 8*a*, and attached to the damper 7 so as to be supported in a floating state.

The both ends of the voice coil 8 are directed out of the coil bobbin 8*a* so as to be connected to a pair of leads 8*b*. Each of the leads 8*b* is attached to the damper 7 by stitching and connected to one of a pair of positive and negative terminals provided on the frame 4.

Figure 2:
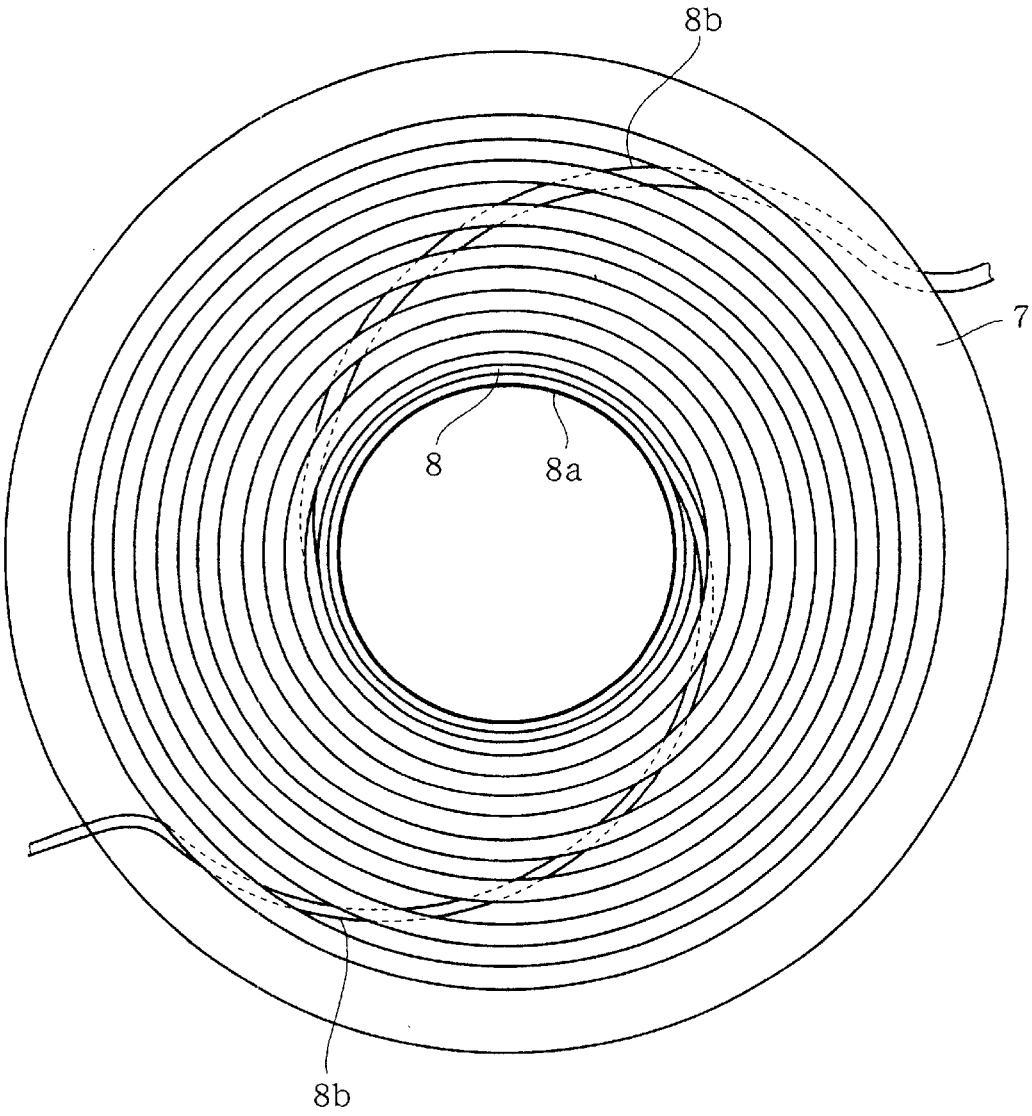
FIG. 2 is a plan view of a damper and a voice coil bobbin mounted thereon, provided in the loudspeaker.

Referring to FIG. 2, the damper 7 is a corrugation damper having a corrugated section and comprising a piece of fabric soaked in resin, molded by heat, and formed into an annular shape. The voice coil bobbin 8*a* is attached to the inner periphery of the damper 7 and the leads 8*b* connected to the voice coil 8 are spirally attached to the damper 7 from the inner periphery toward the outer periphery. Since the leads 8*b* are securely mounted on the damper 7, the leads 8*b* are prevented from contacting the diaphragm, so that the problem of the noise is resolved.

Figure 3:
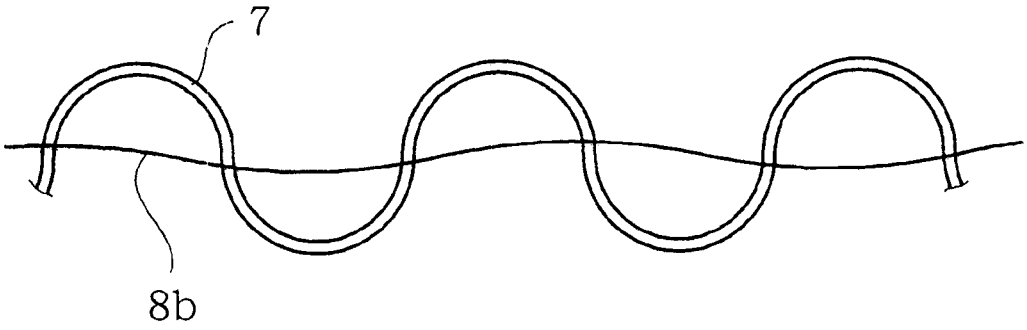
FIG. 3 is an illustration showing a lead attached to the damper of FIG. 2.
Figure 4A:
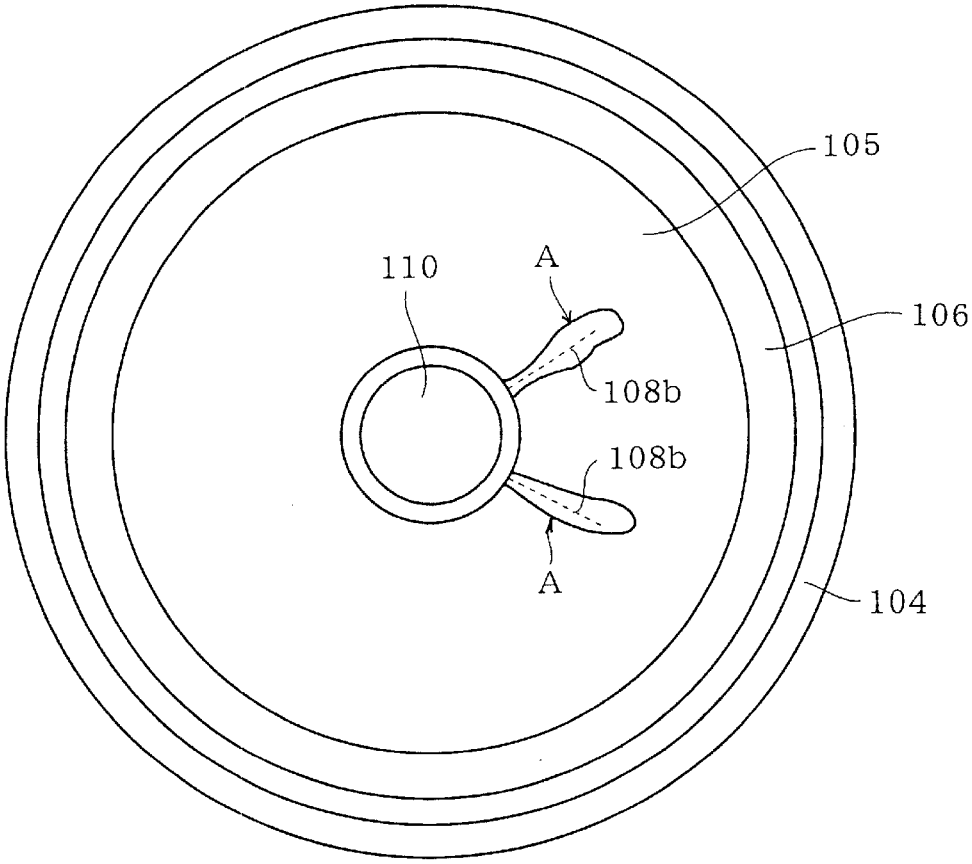
FIG.4 a PRIOR ART
FIG. 4*a* is a plan view showing a main part of a conventional electrodynamic loudspeaker.
Figure 4B:
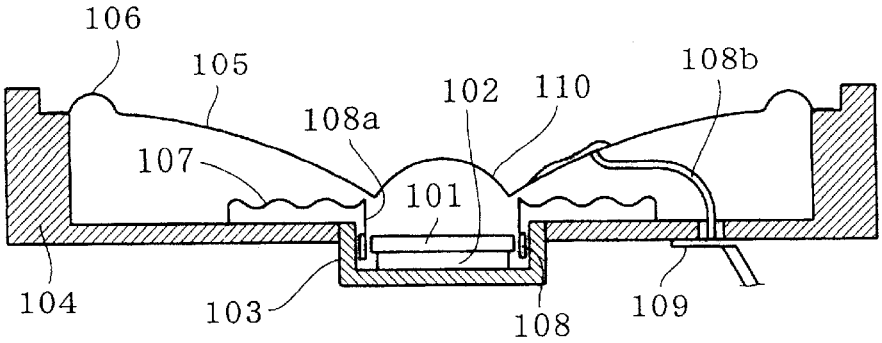
FIG.4 b PRIOR ART
FIG. 4*b* is a plan view of the conventional loudspeaker.

As shown in FIG. 3 in detail, each lead 8*b* is threaded through the damper 7, thereby appearing alternately on the upper side and the underside of the damper. Hence, the resilient force exerted on the upper side and the underside of the damper 7 is balanced, so that the resilience characteristic of the damper is not lost by the tension of the leads 8*b*. When the damper 7 is corrugated as in the present embodiment, the threading of the leads 8*b* can be relatively easily carried out.

The leads 8*b* can be threaded in various manner instead of spirally. For example, the leads 8*b* can be threaded linearly in the radial direction of the damper 7. However, the vibration of the damper 7 causes the load exerted on the leads 8*b* to become maximum, so that the leads are liable to be broken. In view of the above, it is preferable to spirally thread the leads 8*b*.

The outer periphery of the thus constructed damper 7 is attached to the frame 4. The damper 7 resiliently supports the diaphragm 5 supported by the edge 6, voice coil 8 and the voice coil bobbin 8*a* at respective positions and suspensively supports the voice coil 8 in a magnetic gap of the magnetic circuit.

In operation, a driving current is applied through the positive and negative terminals 9, so that the magnetic circuit drives the voice coil 8 suspended in the magnetic circuit. Hence, the diaphragm 5 is vibrated through the voice coil bobbin 8*a*, thereby generating sounds.

From the forgoing it will be understood that in accordance with the present invention, the leads connected to the voice coil are deflected together with the damper when the diaphragm is vibrated, without colliding against the diaphragm and the damper. Accordingly, there is no need to provide an extra space between the diaphragm and the damper, thereby enabling to reduce thickness of the loudspeaker in the moving direction of the diaphragm.

While the invention has been described in conjunction with preferred specific embodiment thereof, it will be understood that this description is intended to illustrate and not limit the scope of the invention, which is defined by the following claims.

What is claimed is:

1. A loudspeaker having a cylindrical frame, a magnetic circuit formed on the frame, a voice coil disposed in a magnetic gap of the magnetic circuit, and a diaphragm, comprising:

a damper having a corrugated sectional shape, said damper being attached to the frame and supporting the voice coil; and leads connected to both ends of the voice coil, the leads being stitched through a center portion of said corrugated sectional shape of said damper, thereby appearing alternately on both surface sides of said damper.

2. The loudspeaker according to claim 1 wherein each of the leads is spirally disposed on the damper.

3. The loudspeaker according to claim 1, wherein said leads are stitched through said damper to keep a predetermined distance between said leads and each top of corrugations of said damper.

4. A loudspeaker having a cylindrical frame, a magnetic circuit formed on the frame, a voice coil disposed in a magnetic gap of the magnetic circuit, and a diaphragm, comprising:

an annular damper having a corrugated sectional shape, said annular damper being attached to the frame at an outer periphery and connected to the voice coil at an inner periphery so as to support the voice coil in a floating state, leads connected to both ends of the voice coil, the leads being stitched through a center portion of said corrugated sectional shape of said annular damper, thereby appearing alternately on both surface sides of said annular damper.

5. The loudspeaker according to claim 4 wherein each of the leads is spirally disposed on the damper.

* * * * *

UNITED STATES PATENT AND TRADEMARK OFFICE

CERTIFICATE OF CORRECTION

PATENT NO. : 6,597,798 B1
DATED : July 22, 2003
INVENTOR(S) : Nakazono et al.

It is certified that error appears in the above-identified patent and that said Letters Patent is hereby corrected as shown below:

Title page,
Item [73], Assignee, please change "Pioneer Electronics Corporation" to
-- Pioneer Electronic Corporation --

Signed and Sealed this

Twenty-seventh Day of April, 2004

JON W. DUDAS
*Acting Director of the United States Patent and Trademark Office*